US009422737B2

(12) United States Patent
Black et al.

(10) Patent No.: US 9,422,737 B2
(45) Date of Patent: Aug. 23, 2016

(54) RETRACTABLE COVER

(76) Inventors: Robert David Black, Oxford (GB); John Alexander Black, Oxford (GB)

( * ) Notice: Subject to any disclaimer, the term of this patent is extended or adjusted under 35 U.S.C. 154(b) by 243 days.

(21) Appl. No.: 14/131,087

(22) PCT Filed: Jul. 4, 2012

(86) PCT No.: PCT/GB2012/051561

§ 371 (c)(1),
(2), (4) Date: Apr. 14, 2014

(87) PCT Pub. No.: WO2013/005033

PCT Pub. Date: Jan. 10, 2013

(65) Prior Publication Data

US 2014/0208501 A1 Jul. 31, 2014

(30) Foreign Application Priority Data

Jul. 6, 2011 (GB) ..... 1111556.5

(51) Int. Cl.
*E04H 4/00* (2006.01)
*E04H 4/08* (2006.01)
(Continued)

(52) U.S. Cl.
CPC ..... *E04H 4/082* (2013.01); *E04B 1/342* (2013.01); *E04B 1/344* (2013.01); *E04B 1/3441* (2013.01);
(Continued)

(58) Field of Classification Search
CPC ... E04B 1/342; E04B 1/34378; E04B 1/3441; E04B 1/34373; E04B 1/3443; E04B 1/344; E04B 1/3445; E04H 3/28; E04H 4/088; E04H 4/082
USPC ..... 4/504, 498–503
See application file for complete search history.

(56) References Cited

U.S. PATENT DOCUMENTS 3,086,256 A 4/1963 Schieber, Jr.
3,091,816 A 6/1963 Wetzel
5,016,403 A 5/1991 Fujita
6,708,706 B1 * 3/2004 Robinson ..... E04H 3/165 135/117

(Continued)

FOREIGN PATENT DOCUMENTS

EP 2341199 A1 12/2010
FR 2 506 816 3/1982

OTHER PUBLICATIONS

International Search Report with Written Opinion for corresponding patent application No. PCT/GB2012/051561 dated Oct. 8, 2012.

(Continued)

*Primary Examiner* — Huyen Le
*Assistant Examiner* — Christine Skubinna
(74) *Attorney, Agent, or Firm* — Renner, Otto, Boisselle & Sklar, LLP

(57) ABSTRACT

A retractable cover for use over an opening such as a swimming pool is described. The cover comprises a number i (i≥3) of supporting joist means, each joist having a top and bottom surface; an even number j (j<i) of floor section means, each having a first and second end; the first end of a 1st floor section being pivotally fixed to the top surface of a 1st joist, and the first end of the jth floor section pivotally being fixed to the top surface of the ith joist, the first ends of the 2nd . . . j−1th floor sections being pivotally fixed to the top surfaces of joists between said 1st and jth joists but spaced so that there is at least one joist between each joist with a floor section fixed to its top surface; said top ends of each adjacent floor section are pivotally joined above said at least one joist so the floor sections for a continuous pivotally joined floor, wherein, when the floor is retracted each of the joists is adjacent to, or a minimal distance away from the adjacent joist(s) and the floor sections are pivoted to form an accordion pleat arrangement, and when the cover is fully extended, the joists are separated out to a maximum separation distance, d, and the floor sections lie flat over said joist to form a continuous cover over said opening.

20 Claims, 6 Drawing Sheets

(51) Int. Cl.

| | |
|---|---|
| ***E04B 1/342*** | (2006.01) |
| ***E04B 1/343*** | (2006.01) |
| ***E04B 1/344*** | (2006.01) |
| ***E04H 3/28*** | (2006.01) |

(52) U.S. Cl.

CPC ..... *E04B 1/3445* (2013.01); *E04B 1/34373* (2013.01); *E04B 1/34378* (2013.01); *E04B 1/34384* (2013.01); *E04H 3/28* (2013.01); *E04H 4/088* (2013.01)

(56) References Cited

U.S. PATENT DOCUMENTS 6,836,907 B1 * 1/2005 Pesta ..... E04H 4/10
139/383 R

OTHER PUBLICATIONS

Combined Search and Examination Report for corresponding patent application No. GB 1111556.5 dated Oct. 22, 2012.

* cited by examiner

RETRACTABLE COVER

This application is a national phase of International Application No. PCT/GB2012/051561 filed Jul. 4, 2012 and published in the English language.

This invention relates a retractable cover particularly, though not exclusively, suitable for covering a swimming pool. The cover provides a firm solid surface to allow the surface to be used as a dance floor for example.

BACKGROUND

Outdoor swimming pools are becoming more and more popular. However they need to be regularly cleaned to remove dropped leaves for example, and when not in use, they can lose heat very quickly from their exposed top surface. This can be overcome by covering the pool. Ordinarily this is commonly addressed by providing a retractable plastic or fabric cover which is typically provided on a roller adjacent to the pool, and when it is necessary to cover the pool, the cover is simply unrolled and pulled over the pool. Typically these covers are fabric and although they do successfully cover the pool thus minimising debris entry and heat loss, they do not permit the covered surface to be used in any other way, as they are simply too weak to bear any additional weight.

BRIEF SUMMARY OF THE DISCLOSURE

According to a first aspect of the present invention there is provided a retractable cover for use over an opening comprising;

a number i ($i \geq 3$) of supporting joist means, each joist having a top and bottom surface;

an even number j ($j<i$) of floor section means, each having a first and second end;

the first end of a 1st floor section being pivotally fixed to the top surface of a 1st joist, and the first end of the jth floor section pivotally being fixed to the top surface of the ith joist, the first ends of the 2nd . . . j−1th floor sections being pivotally fixed to the top surfaces of joists between said 1st and jth joists but spaced so that there is at least one joist between each joist with a floor section fixed to its top surface;

said top ends of each adjacent floor section are pivotally joined above said at least one joist so the floor sections form a continuous pivotally joined floor, wherein, when the floor is retracted each of the joists is adjacent to, or a minimal distance away from the adjacent joist(s) and the floor sections are pivoted to form an accordion pleat arrangement, and when the cover is fully extended, the joists are separated out to a maximum separation distance, d, and the floor sections lie flat over said joist to form a continuous cover over said opening.

According to a first preferred version of the first aspect of the present invention there are provided movement means affixed to the bottom surfaces of at least the 1st and ith joist means. Typically the movement means are pairs of wheel means attached to either end of the bottom surfaces of every joist means. Alternatively the movement means are casters and/or ball bearings. The movement means could also be skid runners affixed to the bottom surfaces of at least the 1st and ith joist means.

According to a second preferred version of the first aspect of the present invention or of the first preferred version thereof $j=i-1$, and said at least one joist is one joist between each said joist with a floor section fixed to its top surface, and said pivotally joined top ends of said floor sections are positioned over said joist.

According to a third preferred version of the first aspect of the present invention or of the first or second preferred versions thereof there is provided a retractable cover wherein, when said cover is fully extended, said top ends of said floor section that are pivotally joined are located directly above said at least one joist, and are secured to the top surface of said at least one joist by locking means.

According to a fourth preferred version of the first aspect of the present invention or of any preceding preferred version thereof the joists are all substantially the same depth.

According to a fifth preferred version of the first aspect of the present invention or of any preceding preferred version thereof the joists are at least as wide as the width of the opening to be covered.

According to a sixth preferred version of the first aspect of the present invention or of any of the first to the fourth preferred versions thereof the joists are wider than the width of the opening to be covered.

In embodiments of the invention, it is possible for the joists to be narrower than the width of the opening to be covered. In this case, an additional support structure may be provided to support the cover over the opening. For example, a central support may be provided across the opening. A plurality of covers may be provided to cover the opening.

According to a second aspect of the present invention the opening is a swimming pool provided with a retractable cover according to the first aspect or any preceding preferred version thereof.

According to a first preferred version of the second aspect of the present invention wherein when the retractable cover is in place it is secured to the outer rim of the pool by locking means to ensure the cover does not move.

According to a second preferred version of the second aspect of the present invention or of the first preferred version thereof wherein the movement means move said joists along the edges of said swimming pool. Typically said movement means are skid means and said swimming pool is provided with tracks alongside said pool for said skid means to move along.

According to a third aspect of the present invention there is provided a retractable cover according to the preceding first or second aspects or any preferred versions thereof wherein the cover is extended and retracted automatically.

According to a fourth preferred version of the first, second or third aspects of the present invention or of any preceding preferred versions thereof the cover is extended and retracted manually.

According to a fifth aspect of the present invention retractable cover according to the first to the fourth aspects or any preferred versions thereof wherein, when the cover is retracted and not in use, it is adapted for removal from the vicinity of the opening.

Typically the retractable cover includes a container for housing the cover when it is not in use.

The pivotally joined second ends of the floor sections may be joined directly to each other or may be pivotally joined by an intermediate component, for example a joist. In one embodiment of the invention, said pivotally joined second ends of said floor sections are pivotally joined to each other by a hinge. The cover may comprises at least one pair of struts connected between two joists each having a floor section fixed to its top surface. The struts may be mutually pivotally connected at a pivot point between the said two joists and the struts may have a combined length greater than the distance between the said two joists when the cover is fully extended. In this way, the struts are maintained at a non-zero angle to each other even when the cover is fully extended. Movement of the said two joists towards each other causes upward movement of the pivot point. The struts may comprise at least one member arranged to engage the floor sections fixed to said two joists during said upward movement to cause mutual pivoting of the floor sections. In this way, the member ensures that the pivotally connected floor sections fold up as the cover is retracted.

The said member may be provided at the said pivot point. Alternatively, the said member may be provided on the struts. In a preferred embodiment, the said member is located substantially directly below the hinge. A joist may be provided between said two joists, said joist having defined therein a recess for receiving said member when the cover is fully extended. In this way, the member does not interfere with the flatness of the surface provided by the floor sections.

As an alternative to the above-described strut arrangement, other mechanisms may be provided to engage the pivot point during folding of the cover to "break" the flat floor section at the start of the folding process. Such mechanisms may include bolts, levers or other members that are retracted into the joists when the cover is fully unfolded and can be released to engage the floor sections when the cover is to be folded. Such bolts or members may comprise springs which propel the members towards the floor sections when the cover is to be folded. The bolts or members may be retained within the joists by a release mechanism against the resilience of the springs while the cover is flat. The release mechanism may be actuated to release the bolts or members and thereby initiate the folding process.

In an alternative embodiment, the said pivotally joined second ends of said floor sections are pivotally joined by means of a respective pivotal connection to a joist. Thus, the floor sections are pivotally connected to a joist in the region of their second ends. In this way, the joist can be carried between the floor sections. The pivotal connection may be spaced from the second end of the floor section. This allows pivoting while allowing a continuous surface of the floor sections when the cover is fully extended. Typically, said pivotal connection is provided on a side of said joist.

BRIEF DESCRIPTION OF THE DRAWINGS

Embodiments of the invention are further described hereinafter with reference to the accompanying drawings, in which.

DETAILED DESCRIPTION

Figure 1A:
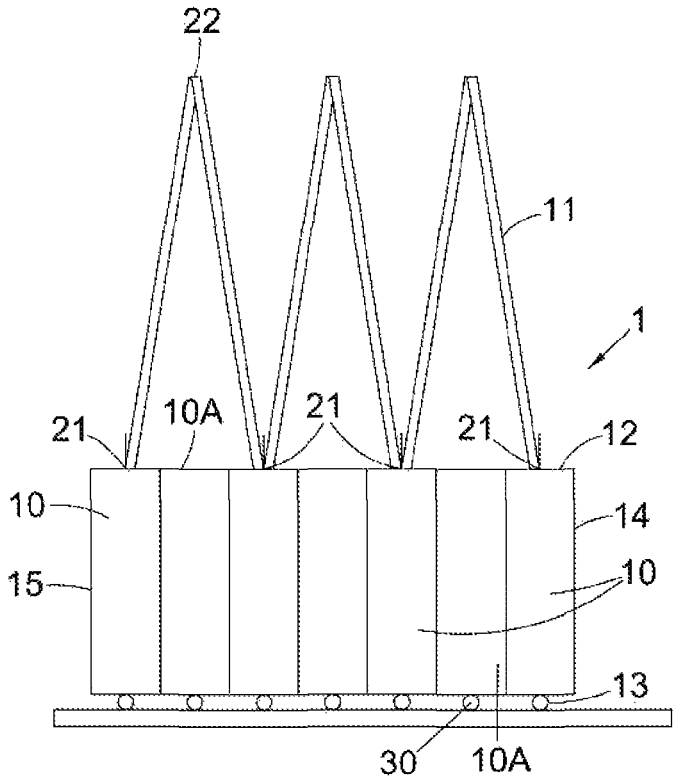
FIG. 1(*a*) shows a cross-sectional view of the retractable cover when it is fully retracted, FIG. 1(*b*) shows a cross-sectional view of the retractable cover when it is partially retracted or extended, FIG. 1(*c*) shows across-sectional view of the retractable cover when it is fully extended, FIG. 2(*a*) shows a top view of a swimming pool with the cover fully extended over the swimming pool, FIG. 2(*b*) shows a cross-sectional view along line Y-Y of FIG. 2(*a*), FIG. 2(*c*) shows a cross-sectional view along line X-X of FIG. 2(*a*)
Figure 1B:
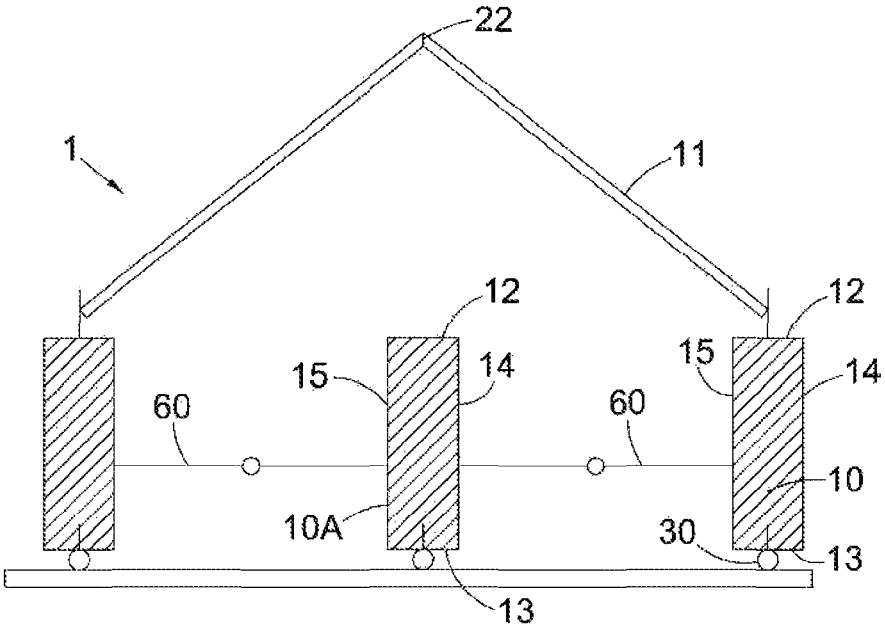
Figure 1C:
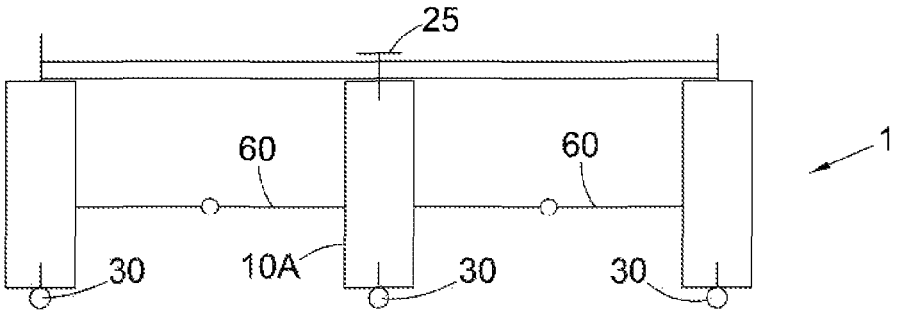

FIG. 1(*a*) shows a cross sectional view of a retractable cover 1 when fully retracted. Briefly, cover 1 comprises joist 10, 10A and floor sections 11. Joists 10, 10A are arranged alternately and both have top surface 12, bottom surface 13 and longitudinal side faces 14, 15.

Above joists 10, 10A are arranged floor sections 11. These have a first end 21, which is positioned on top of the top surface 12 of joist 10, and a second end 22 joined to the second end of the adjacent floor section 11 and positioned above, and clear of joist 10A. Several floor sections 11 are joined together in this fashion above joist 10, 10A, and when the cover is fully retracted they form a substantially accordion pleated type arrangement above the joists 10, 10A.

First ends 21 are pivotally connected to the top surface 12 of joists 10 and this is a permanent hinge connection that cannot be released from the joist, but can be pivoted about it axis to move closer to, away from top surface 12 of joists 10, 10A.

Second ends 22 are also pivotally joined together via a hinge mechanism, and as shown in FIG. 1(*c*) when cover 1 is fully extended, ends 22 rest on the top surface of joist 10A, between joists 10 where the first ends 21 are fixed. A locking mechanism 25, preferably a locking pin is inserted through the pivotal connection at ends 22 to releasably lock the floor sections 11 to the top surface of joists 10A. In this manner when the cover 1 is in use, the cover is fully secured and the floor will not move, but when the cover 1 is no longer needed, the locking pins 25 can be easily and quickly removed from the pivotal connection to allow the floor sections 11 to be released from joist 10A. As also shown in FIGS. 1(*a*) and (*b*) the joists 10, 10A, may also be connected sequentially by pantograph units 60 (shown in more detail in FIG. 4).

Each unit 60 is positioned between adjacent joists, and can be positioned with one end on side face 14 and the other end on opposing side face 15 of the adjacent joist 10, 10A. Pantograph units 60 may be positioned anywhere along the side faces 14, 15 of joists 10, 10A, but are preferably centrally located. Also shown on FIG. 1(*c*) are wheels 30, positioned at either end of joists 10, 10A.

Figure 5:
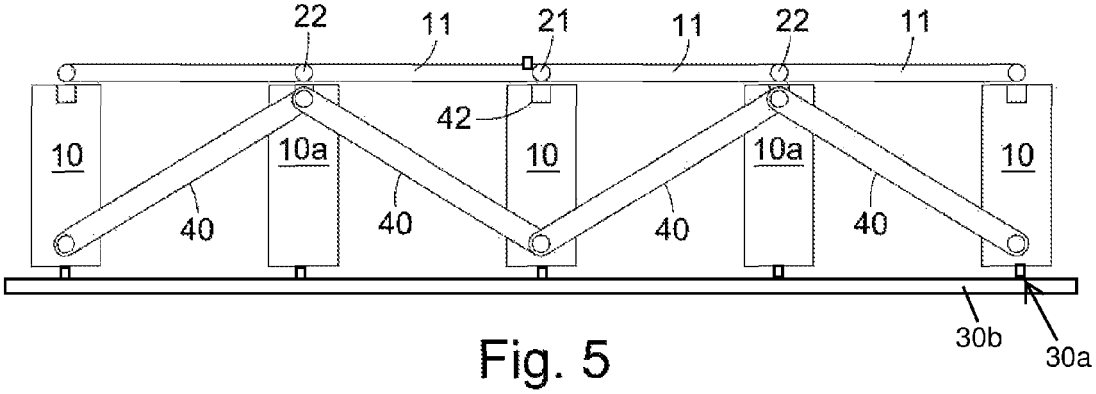
FIGS. 5 and 6 show schematically a further embodiment of the invention.

These may be casters or ball bearings for example, and are used to allow the cover 1 to be easily extended and retracted. In the preferred embodiment there are wheels 30 at each end of every joist 10, 10A, but this is not essential. They may be regularly spaced between the joists, or only provided to the first and last joists 10, to enable easy movement of the cover. Alternatively, as shown in FIG. 5, they may be specially configured skids 30*a* for running along a track 30*b* for example, where the track 30*b* is located alongside the opening to be covered.

To extend the cover 1 it is simply wheeled to the pit or area to be covered (preferably a swimming pool) and then pulled out into position. As the cover 1 is extended it passes through the configuration shown in FIG. 1(*b*), and ultimately ends in the configuration shown in FIG. 1(*c*). Once the floor sections 11 are flat against the joists 10, 10A, securing means, in this case locking pin 25, are inserted through each of the pivoted connections between ends 22, thus securing each floor section 11 to the joist 10A above which it is resting. This ensures the floor is held firmly in position against the joists 10A. As ends 21 of floor sections are already firmly fixed to joists 10 no additional securing means is needed here.

To retract the cover 1, this process is simply reversed. The securing means 25 are removed from between each of the pivoted connections 22 and joist 10A to unlock the floor section 11 from joist 10A. Joists 10, 10A are then pushed together and the floor sections will concertina upwards and then retract the cover 1. Once the joists 10, 10A are all adjacent and the floor sections 11 appear as if they are accordion pleated the cover 1 is fully retracted, and if desired can be wheeled away from the area it covered (so if it is a swimming pool the access to the pool is not impaired by the cover). It is also possible to store the cover 1 in a separate box (not shown), which may then be used as a diving platform for example.

Figure 2A:
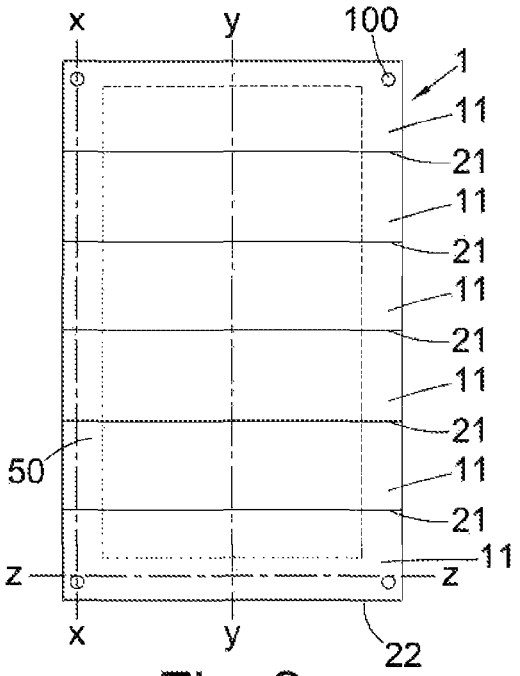
Figure 2B:
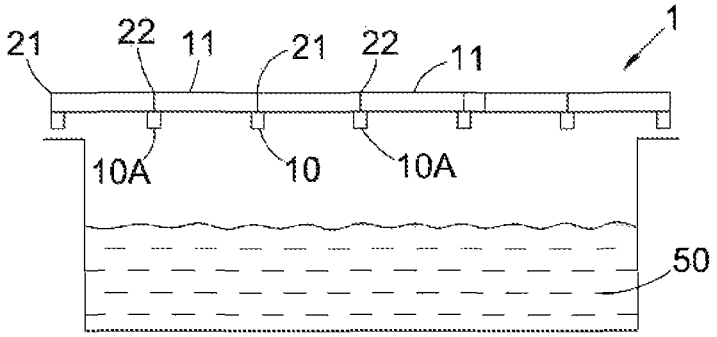
Figure 2C:
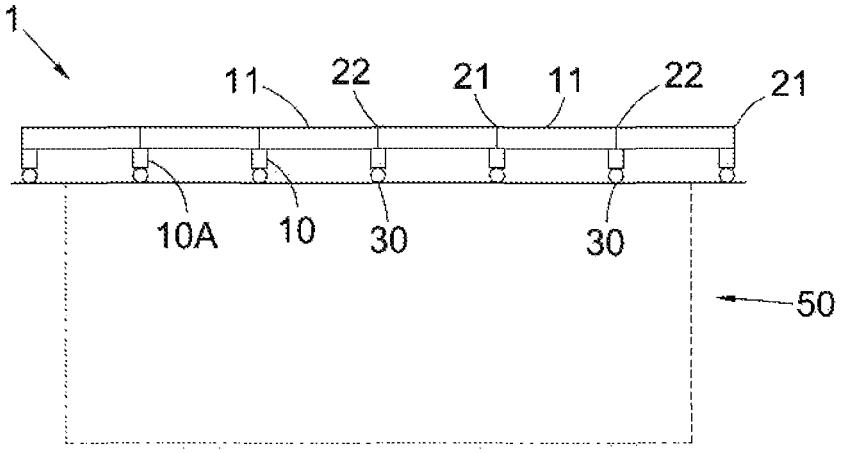
Figure 3:
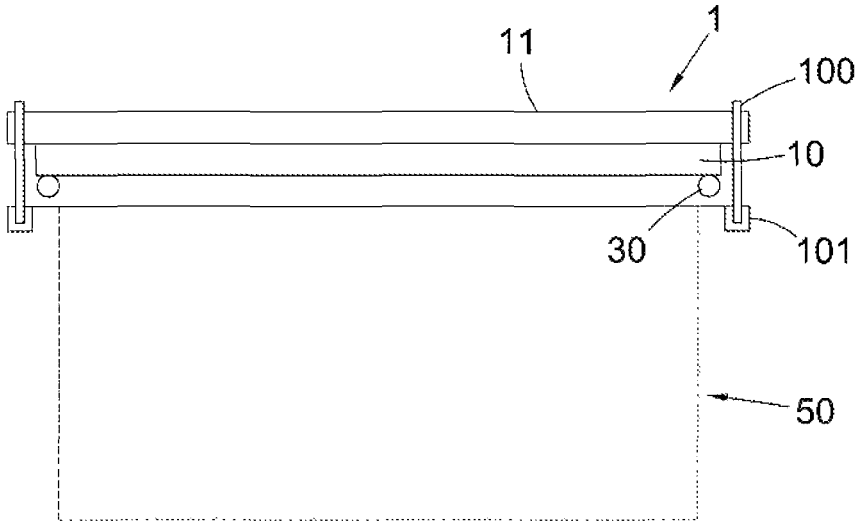
FIG. 3 shows a cross-sectional view along line Z-Z of FIG. 2(*a*)

FIGS. 2(*a*)-(*c*) show top and cross-sectional view of cover in place over a swimming pool 50. FIG. 2(*a*) shows that in the preferred embodiment the cover 1 is longer and wider than the pool 50, and is secured to the pool 50 by locking pins 100, received in locking pits 101 positioned at each corner of the swimming pool. The pins 100 pass through the outer corners of the two floor sections 11 at either end of the cover 1.

The cover could be designed so that the locking pins 100 pass through the outer side of any other of the floor sections 11; as long as there are suitable locking pits 101 at the appropriate part of the swimming pool 50.

It is clear from FIGS. 2(*b*) and (*c*) that wheels 30 rest on the rim around the perimeter of the pool 50, and that the joists do not actually touch the perimeter of the pool. Preferably each of the wheels 30 may be provided with separate locking means (not shown) to provide additional security and stability to prevent the cover moving once it is in position.

Figure 4:
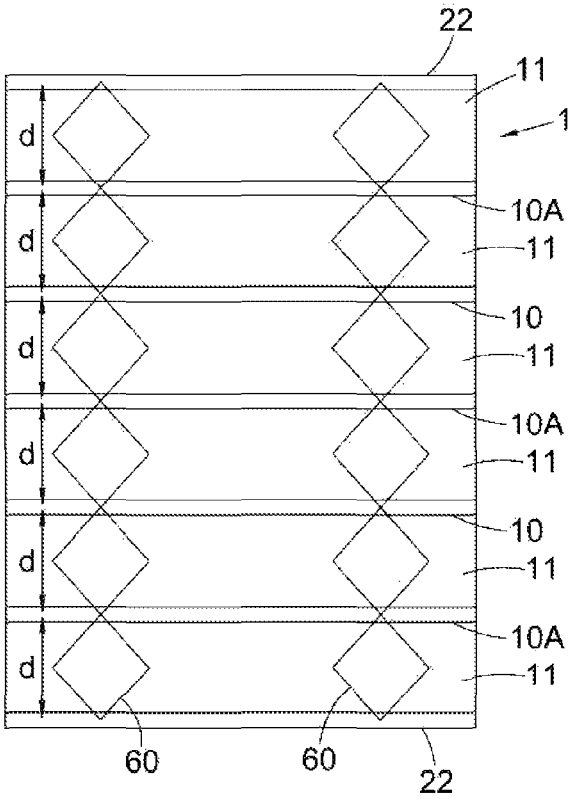
FIG. 4 is an underside view of the cover of FIG. 2(*a*) showing a pantograph connection.

FIG. 4 shows the underside of the cover. This figure shows the joists 10, 10A as linked by the series of pantograph units 60, located at either end of the joists 10, 10A.

Each pantograph 60, operates in the usual manner and is fixed to the centre of each side walls 14, 15 of joists 10, 10A. When the pantographs are fully extended, the cover 1 will be fully extended and lies flat and the joists 10, 10A are evenly spaced with a distance d between each of the joists 10, 10A. When the cover is retracted the pantograph units 60 collapse inwards, in the standard manner.

In the preferred embodiment, the joists and floor sections and are made of the same material, preferably stainless steel however other materials may also be suitable, such as plastic, or wood that has been suitably treated for marine purposes. Also the floor section and joists may be made of any combination of suitable materials, and do not need to be made of the same material.

In a preferred embodiment the cover 1 is used over a horizontal opening and the floor sections 11 and joists 10, 10A are suitably sized to provide a horizontal surface over the opening. However, it is envisaged the cover may also be used over an opening on an incline, in which case the lengths of the joists would gradually increase to match the gradient of the incline, so that when the cover is extended, the cover provides a horizontal surface. Of course, such a cover would require substantial additional locking means around the perimeter to ensure it is fully secure.

Preferably the cover 1, once in position is strong enough to withstand significant pressures to allow the cover to be used as a dance floor for example, or to support garden furniture or the like, without compromising the security and integrity of the cover.

FIG. 5 shows a cover 1 according to a further embodiment of the invention. The same reference numerals are used to describe components of this embodiment that correspond to those of the preceding embodiment. As shown in FIG. 5, each of the floor sections 11 is provided between adjacent first and second joists 10, 10*a*. The floor sections 11 are each pivotally mounted at a first end 21 to one of the first joists 10 and pivotally connected to the adjacent floor section 11 at their second end 22. At their second ends 22, the floor sections 11 rest on the joists 10 in the position shown in FIG. 5. In this embodiment, the first and second joists 10, 10*a* are connected by struts 40. Each strut is pivotally mounted to the lower end of a first joist 10 and is pivotally connected to the adjacent strut 40 upwardly of the pivotal connection to the first joist 10. At the pivotal connection between adjacent struts 40, the connected struts 40 are provided with a short spigot (not shown) which projects inwardly in a direction transverse to the longitudinal direction of the struts 40. Each of the second joists 10*a*, is provided with a recess 42 at its upper end which is dimensioned to receive the spigot (the first joists 10 also include such a recess, but only so that the first and second joists can be manufactured identically). In the position shown in FIG. 5, the spigots of the struts 40 are located in the recesses of the second joists 10*a* below the pivotal connection 22 between adjacent floor sections. It should also be noted that the struts 40 are longer than the distance between adjacent first and second joists. In this way, adjacent struts 40 are at a non-zero angle to each other when the cover 1 is fully extended. The second joists 10*a* are connected to the first joists 10 by a pantograph mechanism 60, as previously described. The pantograph mechanism 60 may be connected to the lower ends of the joists 10, 10*a*.

Figure 6:
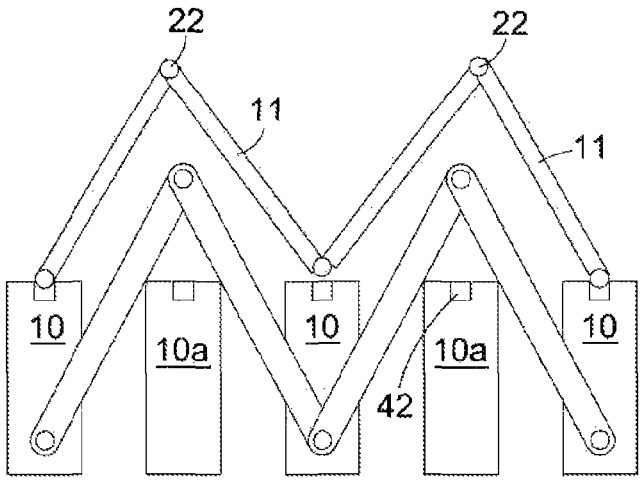

As shown in FIG. 6, when the cover of FIG. 5 is folded up, the joists 10 move towards each other. Consequently, the pivotal connection between adjacent struts 40 moves upwardly, causing the spigot to leave the recess 42 and bear against the underside of the pivotal connection 22 between adjacent floor sections. This movement "breaks" the flat floor sections 11 at the pivotal connection 22, allowing the cover to fold up. Thus the spigots prevent the situation where the cover is locked in the open position because all of the floor sections 11 are aligned horizontally. The provision of the spigots greatly improves the ease of folding of the cover 1.

Figure 7:
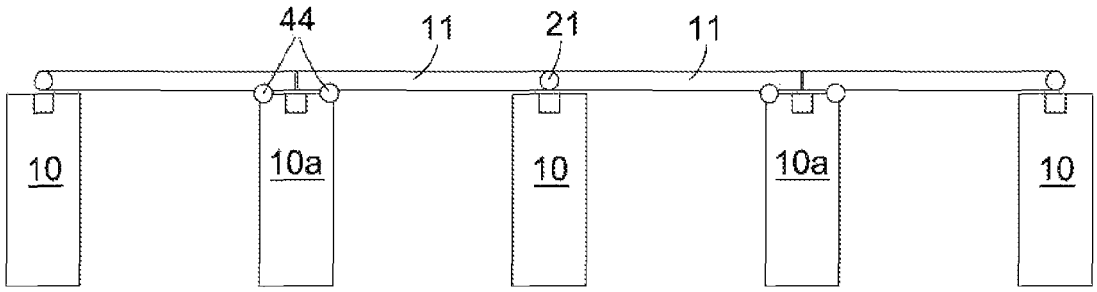
FIGS. 7 and 8 show schematically a yet further embodiment of the invention.
Figure 8:
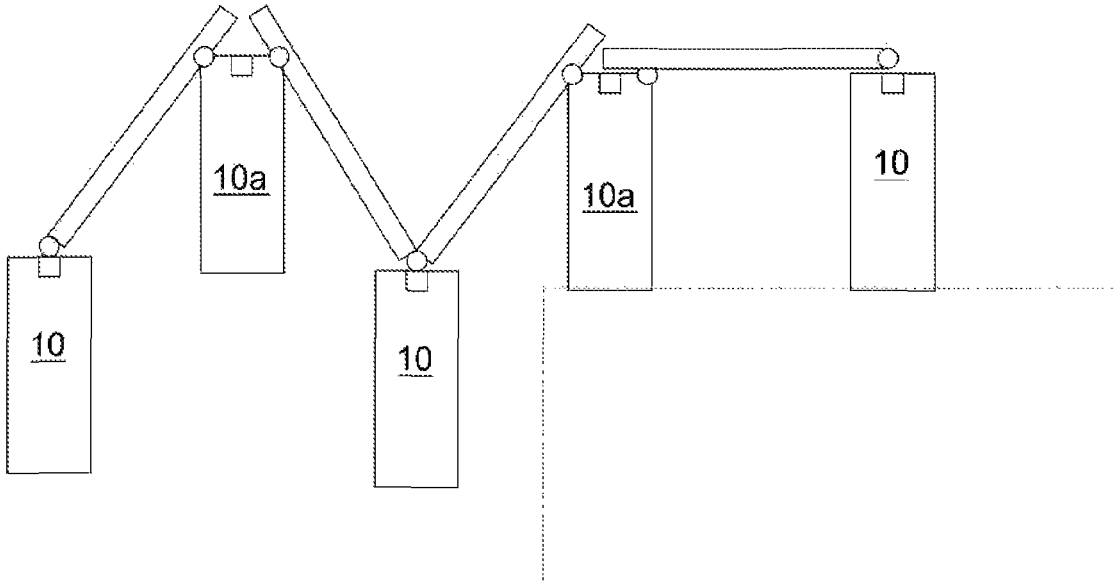

FIG. 7 shows a yet further embodiment of the invention. In this embodiment, the ends of the floor sections 11 are not connected to each other at their second ends 22, but each floor section 11 is pivotally connected to a respective side of a second joist 10*a* by a hinge 44. Thus, as shown in FIG. 8, the cover of this embodiment can be folded by lowering the first joists 10 with respect to the second joists 10. In this embodiment, the joists 10, 10*a* are connected by the floor sections 11 and pivots, so that a pantograph mechanism or struts are not necessary. When the cover 1 is fully extended as shown in FIG. 7, the first joists 10 rest on the edges of the swimming pool (or other structure) to be covered, such that the cover provides a stable upper surface. This embodiment has the advantage that the cover can be stored in a box or container below the level of the edges of the swimming pool (indicated by the dashed line in FIG. 8), because the first joists move downwardly to fold the cover 1.

The cover 1 herein before described is operated manually, however it may be possible to provided motorised control so that the cover can be operated automatically if desired. Also, the preferred embodiment described herein has the cover used for a swimming pool, but the cover may of course be used for many other different openings, such as maintenance pits found in garages for example.

Throughout the description and claims of this specification, the words "comprise" and "contain" and variations of them mean "including but not limited to", and they are not intended to (and do not) exclude other components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The invention claimed is:

1. A retractable cover for use over an opening comprising;

a number i ($i \geq 3$) of supporting joists, each joist having a top and bottom surface;

an even number j ($j<i$) of floor sections, each having a first and second end;

the first end of a 1st floor section being pivotally fixed to the top surface of a 1st joist, and the first end of the jth floor section pivotally being fixed to the top surface of the ith joist, the first ends of the 2nd . . . j−1th floor sections being pivotally fixed to the top surfaces of joists between said 1st and jth joists but spaced so that there is at least one joist between each joist with a floor section fixed to its top surface;

said second ends of each adjacent floor section are pivotally joined above said at least one joist so the floor sections form a substantially continuous pivotally joined floor, wherein, when the floor is retracted each of the joists is adjacent to, or a minimal distance away from the adjacent joist(s) and the floor sections are pivoted to form an accordion pleat arrangement, and when the cover is fully extended, the joists are separated out to a maximum separation distance, d, and the floor sections lie substantially flat over said joists to form a continuous cover over said opening.

2. A retractable cover according to claim 1, further comprising movement devices affixed to the bottom surfaces of at least the 1st and ith joists.

3. A retractable cover according to claim 2, wherein the movement devices are pairs of wheels attached to either end of the bottom surfaces of every joist.

4. A retractable cover according to claim 3, wherein said wheels are casters and/or ball bearings.

5. A retractable cover according to claim 2, wherein the movement devices are skid runners affixed to the bottom surfaces of at least the 1st and ith joists.

6. A retractable cover according to claim 1, wherein $j=i-1$, and said at least one joist is one joist between each said joist with a floor section fixed to its top surface, and said pivotally joined second ends of said floor sections are positioned over said joist.

7. A retractable cover according to claim 1, wherein said pivotally joined second ends of said floor sections are pivotally joined to each other by a hinge.

8. A retractable cover according to claim 7, further comprising at least one pair of struts connected between two joists each having a floor section fixed to its top surface, the struts being mutually pivotally connected at a pivot point between the said two joists and the struts having a combined length greater than the distance between the said two joists when the cover is fully extended, whereby movement of the said two joists towards each other causes upward movement of the pivot point, and wherein the struts comprise at least one member arranged to engage the floor sections fixed to said two joists during said upward movement to cause mutual pivoting of the floor sections.

9. A retractable cover as claimed in claim 8, wherein the said member is provided at the said pivot point.

10. A retractable cover as claimed in claim 8, wherein the said member is located substantially directly below the hinge.

11. A retractable cover as claimed in claim 8, wherein a joist is provided between said two joists, said joist having defined therein a recess for receiving said member when the cover is fully extended.

12. A retractable cover according to claim 1, wherein said joists are all substantially the same depth.

13. A retractable cover according to claim 1, wherein a length of said joists is at least as wide as a width of the opening to be covered.

14. A retractable cover according to claim 1, wherein a length of said joists is wider than a width of the opening to be covered.

15. A retractable cover according to claim 1, wherein said opening is a swimming pool.

16. A retractable cover according to claim 15, wherein when the cover is in place it is securable to an outer rim of the pool by a lock to ensure the cover does not move.

17. A retractable cover according to claim 15, wherein movement devices are provided for moving said joists along the edges of said swimming pool.

18. A retractable cover according to claim 17, wherein said movement devices are skid runners and said swimming pool is provided with tracks alongside said pool for said skid means to move along.

19. A retractable cover according to claim 1, wherein the cover is extendable and retractable manually.

20. A retractable cover according to claim 1, wherein the cover is extendable and retractable automatically.

* * * * *